US005928041A

United States Patent [19]

Anderson et al.

[11] Patent Number: 5,928,041

[45] Date of Patent: Jul. 27, 1999

[54] ROTARY VALVE ACTUATED HYDRAULIC STEERING SYSTEM

[75] Inventors: David J. Anderson, Plymouth; Jason Danner, Eagan, both of Minn.

[73] Assignee: Commercial Intertech Corp., Minneapolis, Minn.

[21] Appl. No.: 09/020,560

[22] Filed: Feb. 9, 1998

[51] Int. Cl.[6] ..... B63H 5/125

[52] U.S. Cl. ..... 440/61; 114/150

[58] Field of Search ..... 440/61; 114/144 R, 114/150; 60/385, 386

[56] References Cited

U.S. PATENT DOCUMENTS

| | | |
|---|---|---|
| Re. 25,126 | 2/1962 | Charlson . |
| 1,358,454 | 11/1920 | McLeod . |
| 2,608,954 | 9/1952 | Hogan . |
| 2,634,709 | 4/1953 | Fageol . |
| 2,751,752 | 6/1956 | Metcalf . |
| 2,946,193 | 7/1960 | Chittenden . |
| 3,424,260 | 1/1969 | Stone et al. . |
| 3,991,846 | 11/1976 | Chichester et al. . |
| 4,056,160 | 11/1977 | Abels et al. . |
| 4,070,857 | 1/1978 | Wible . |
| 4,100,739 | 7/1978 | Shaffer . |
| 4,184,333 | 1/1980 | Blaha et al. . |
| 4,417,640 | 11/1983 | Abe et al. . |
| 4,449,365 | 5/1984 | Hancock . |
| 4,710,141 | 12/1987 | Ferguson . |
| 4,892,494 | 1/1990 | Ferguson . |
| 4,976,639 | 12/1990 | Rawlings et al. . |
| 5,028,851 | 7/1991 | Wilder . |
| 5,057,043 | 10/1991 | Sugimoto et al. . |
| 5,074,193 | 12/1991 | Hundertmark . |
| 5,127,856 | 7/1992 | Kabuto et al. . |
| 5,146,745 | 9/1992 | Doetsch . |
| 5,188,051 | 2/1993 | Huber . |
| 5,213,527 | 5/1993 | Fetchko . |
| 5,228,405 | 7/1993 | Merten . |
| 5,241,894 | 9/1993 | Hundertmark . |
| 5,330,375 | 7/1994 | Tsujii et al. . |
| 5,350,326 | 9/1994 | Funami et al. . |
| 5,376,029 | 12/1994 | Entringer et al. . |
| 5,387,142 | 2/1995 | Takayanagi et al. . |
| 5,392,690 | 2/1995 | Hundertmark . |
| 5,409,410 | 4/1995 | Bohlin ..... 440/61 |
| 5,427,045 | 6/1995 | Fetchko ..... 114/150 |
| 5,427,555 | 6/1995 | Merten . |
| 5,427,556 | 6/1995 | Ishikawa et al. . |
| 5,447,456 | 9/1995 | Nakayasu . |
| 5,505,641 | 4/1996 | Onoue . |

*Primary Examiner*—Stephen Avila
*Attorney, Agent, or Firm*—Faegre & Benson LLP

[57] ABSTRACT

A power-assist hydraulic system for use in connection with a linkage extending through a housing and mechanically coupled to an actuated member. The power-assisted hydraulic system includes a double-acting hydraulic cylinder having a rod configured for interconnection to the actuated member, an accumulator for storing pressurized hydraulic fluid and a rotary valve. The rotary valve has a valve interface for selectively connecting the hydraulic cylinder to the accumulator. The rotary valve has at least one valve piston for receiving pressurized hydraulic fluid to maintain a hydraulic balance at the valve interface. A sleeve having a bore through which the linkage can extend is mechanically coupled and movably mounted with respect to the rotary valve for moving the rotary valve between a neutral position and first and second rotated positions in response to forces between the linkage and housing. The sleeve and rotary valve cooperate to drive the hydraulic cylinder in a first or a second direction in response to the rotary valve being in the first or the second rotated position, respectively.

36 Claims, 6 Drawing Sheets

ROTARY VALVE ACTUATED HYDRAULIC STEERING SYSTEM

FIELD OF THE INVENTION

The present invention relates generally to a rotary valve actuated power-assisted hydraulic steering system for boats and other vehicles.

BACKGROUND OF THE INVENTION

Power steering systems are well known and in widespread use in cars, trucks, boats and other vehicles. One hydraulic spool valve and cylinder set used in power steering systems for marine applications is commercially available from Eaton Technologies of Eaton Rapids, Mich. This Eaton valve and cylinder set is configured for use in a boat having a linkage cable that extends between the steering wheel and tiller. A rigid rod on the end of the cable is pivotally connected to both the tiller and the valve spool. The cylinder rod is also connected to the tiller. Pressurized hydraulic fluid is provided to the spool valve by a pump that is driven by the boat engine. When the steering wheel is rotated in such a manner as to turn the boat in one direction, the cable mechanically moves the tiller in a first turn direction and simultaneously forces the valve spool to a first actuated position. In response, the valve causes the cylinder to move the tiller in the first turn direction, thereby providing hydraulic steering forces in addition to the mechanical forces provided by the cable. Similarly, when the steering wheel is rotated to turn the boat in a second and opposite direction, the cable mechanically moves the tiller in a second turn direction and simultaneously forces the valve spool to a second actuated position. The valve then causes the cylinder to move the tiller in the second turn direction to provide hydraulic steering forces in addition to the forces provided by the cable.

U.S. Pat. No. 5,028,851(Wilder) discloses a vehicle steering system that utilizes a spool valve to direct hydraulic fluid to a double-acting hydraulic ram. An electric switch on the spool valve controls a pump motor in the response to steering input torque from the steering system so that working fluid is supplied as demanded for the intended maneuver. During periods in which the vehicle may be in use without a steering maneuver being affected, the pump motor remains de-energized thereby alleviating wastage of energy and power for the vehicle. Wilder also discloses the use of a relay with a time delay in the event that the electric switch is rapidly activating and deactivating the motor.

Spool valves have a tendency to leak hydraulic fluid, placing additional strain on the pump. For some applications, such as outboard motors on boats, an unacceptable drain on the power systems can be required to compensate for leakage within the spool valve. The tight machining tolerances necessary to produce a spool valve with minimal leakage results in a system that can be cost prohibitive.

BRIEF SUMMARY OF THE INVENTION

The present invention relates to a power-assist hydraulic system for use in connection with a linkage extending through a housing and mechanically coupled to an actuated member. The power-assisted hydraulic system includes a double-acting hydraulic cylinder having a rod configured for interconnection to the actuated member, an accumulator for storing pressurized hydraulic fluid and a rotary valve. The rotary valve has a valve interface for selectively connecting the hydraulic cylinder to the accumulator. The rotary valve has at least one valve piston for receiving pressurized hydraulic fluid to maintain a hydraulic balance at the valve interface. A sleeve having a bore through which the linkage can extend is mechanically coupled and movably mounted with respect to the rotary valve for moving the rotary valve between a neutral position and first and second rotated positions in response to forces between the linkage and housing. The sleeve and rotary valve cooperate to drive the hydraulic cylinder in a first or a second direction in response to the rotary valve being in the first or the second rotated position, respectively.

The pressurized hydraulic fluid generates a first force at the valve interface and a second opposing force in the valve piston. The first and second forces are preferably substantially equal. A secondary biasing mechanism can optionally be positioned to a maintain a bias at the valve interface. The valve interface defines a first hydraulic surface area and the valve piston defines a second opposing hydraulic surface area substantially equal to the first hydraulic surface area. In one embodiment, the at least one valve piston comprises a plurality of valve pistons positioned to transmit hydraulic pressure to the valve interface. In another embodiment, the valve interface comprises at least three ports and a valve piston opposite each of the ports to transmit hydraulic pressure to the valve interface.

In the illustrated embodiment, the rotary valve comprises a port cap retained in the housing and a barrel rotatably coupled to the linkage. The port cap and the barrel define the valve interface. The interface of the port cap and the barrel defines a first hydraulic surface area and the valve pistons located in the barrel define a second opposing hydraulic surface area substantially equal to the first hydraulic surface area.

The present invention is also directed to a hydraulic steering system for use in combination with a linkage mechanically coupled to an actuated member. The hydraulic steering system has a hydraulic pump, an accumulator for storing pressurized hydraulic fluid and a reservoir of hydraulic fluid. The hydraulic steering system comprising a double-acting hydraulic cylinder having a piston mechanically coupled to the actuated member and configured to move along a first axis in a first direction and a second direction. A sleeve is slideably engaged with a valve housing. The sleeve has a through hole for receiving the linkage. The linkage transmits a first reaction force to move the sleeve in the first direction in response to the linkage moving in the second direction, and a second reaction force to move the sleeve in the second direction in response to the linkage moving in the first direction. A rotary valve assembly having a valve interface is provided for selectively connecting the double-acting hydraulic cylinder to the accumulator. The rotary valve assembly has at least one valve piston for receiving pressurized hydraulic fluid to maintain a hydraulic balance at the valve interface. A mechanical interface is provided between the sleeve and the rotary valve to rotate the rotary valve from a neutral position to a first or a second rotated positioned in response to the first and second reaction forces.

In one embodiment, the rotary valve includes port cap with a first surface having a first cylinder port fluidly coupled to a first chamber of the double-acting cylinder to drive the piston in the first direction upon application of pressurized hydraulic fluid; a second cylinder port fluidly coupled to a second chamber of the double-acting cylinder to drive the piston in the second direction upon application of pressurized hydraulic fluid, a pressure port fluidly coupled to the accumulator; and a return port fluidly coupled to the reservoir. A barrel assembly having a second surface is engaged with the first surface at a valve interface. The barrel assembly rotates from a neutral position to a first rotated position and a second rotated position. The first and second surfaces are configured to fluidly coupling the pressure port with the first cylinder port and the second cylinder port with the return port in the first rotated position, and for fluidly coupling the pressure port with the second cylinder port and the first cylinder port with the return port in the second rotated position. A mechanical interface between the sleeve and the barrel rotates the barrel in response to the first and second reaction forces.

In one embodiment, the rotary valve includes valve pistons fluidly coupled to the pressure port and positioned to transmit hydraulic pressure to bias the barrel to the port cap. The surface area of the valve pistons is preferably substantially equal to the surface area of the ports at the interface between the barrel and the port cap so that the biasing force is substantially equal to the separation force at the interface. Each of the valve pistons act independently with its respective port. Two valve pistons will be in fluid communication with the pressure port when the barrel is in either the first or second rotated positions.

Unlike some spool valves, the present rotary valve is not prone to leak hydraulic fluid internally during operation. Consequently, the amount of power taken from the drive system to operated the present hydraulic steering system is minimized. Low leakage rotary valves are also more efficient to manufacture than low leakage spool valves.

During operation, hydraulic fluid trapped on opposite sides of the piston by the rotary valve retains the drive unit in the desired position. If hydraulic pressure is lost, the rotary valve still operates in response to movement of the cable. Consequently, even without hydraulic pressure, the valve will open to release the hydraulic pressure from the double-acting hydraulic cylinder and permit the drive unit to steered manually.

The present invention is also directed to a boat having a hydraulic steering system in accordance with the present invention.

DETAILED DESCRIPTION OF THE INVENTION

Figure 1:
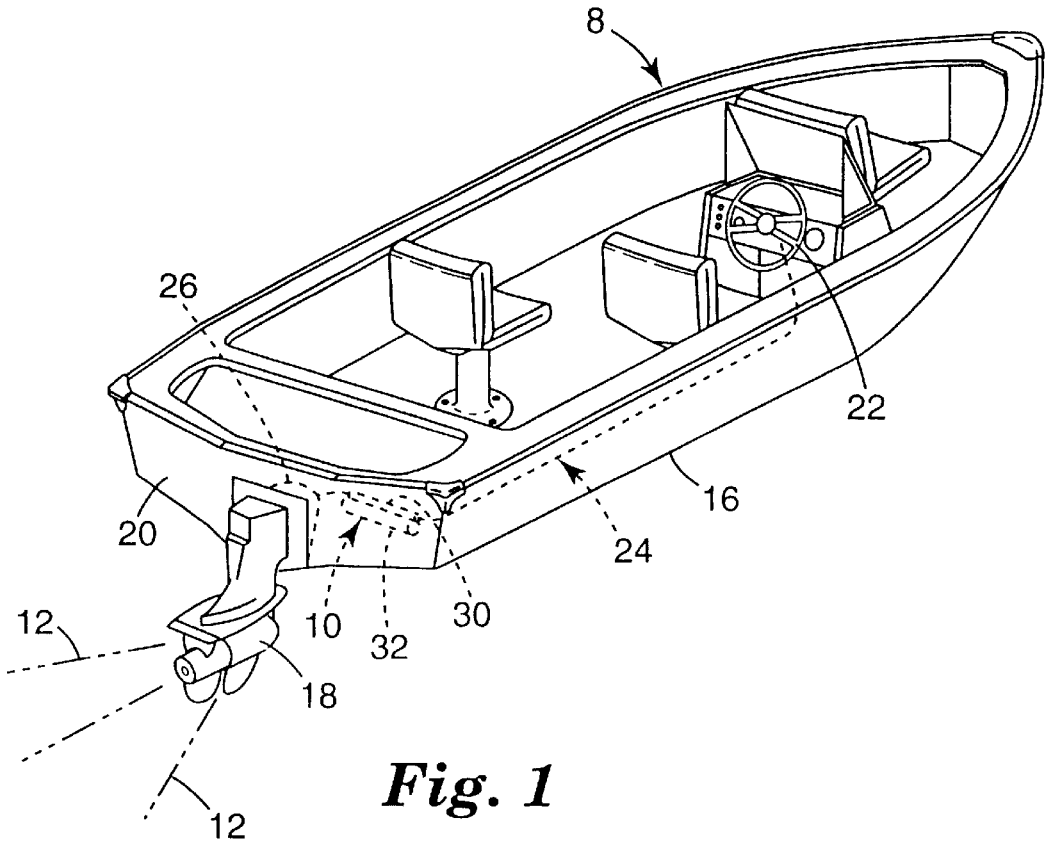
FIG. 1 is a schematic illustration of a boat that includes a power-assisted hydraulic steering system in accordance with the present invention.

FIG. 1 is a perspective view of an exemplary vehicle 8 that includes the hydraulic steering assembly 10 in accordance with the present invention. The hydraulic steering assembly 10 includes a valve assembly 30 and a double-acting hydraulic cylinder 32. Except for the hydraulic steering assembly 10 and its associated hydraulic pump and tank for hydraulic fluid (see FIG. 2) the vehicle 8 is conventional in design and includes a hull 16 and an actuated member 18, such as drive unit 18 pivotally mounted to its stern 20. A driver steers the vehicle 8 by rotation of the steering wheel 22. Steering wheel 22 is coupled to the drive unit 18 by a linkage assembly 24 and a tiller 26. The rotation of the steering wheel 22 causes the linkage assembly 24 to mechanically actuate tiller 26 in a conventional manner, thereby moving the drive unit 18 through steering strokes 12. As is described in greater detail below, the hydraulic steering assembly 10 applies power steering forces to the tiller 26 that are separate from and in addition to the forces manually applied to the tiller 26 by the operator through use of the steering wheel 22. The present hydraulic steering assembly 10 may be used with any actuated member, such as a rudder, inboard motor, outboard motor, etc.

Figure 2:
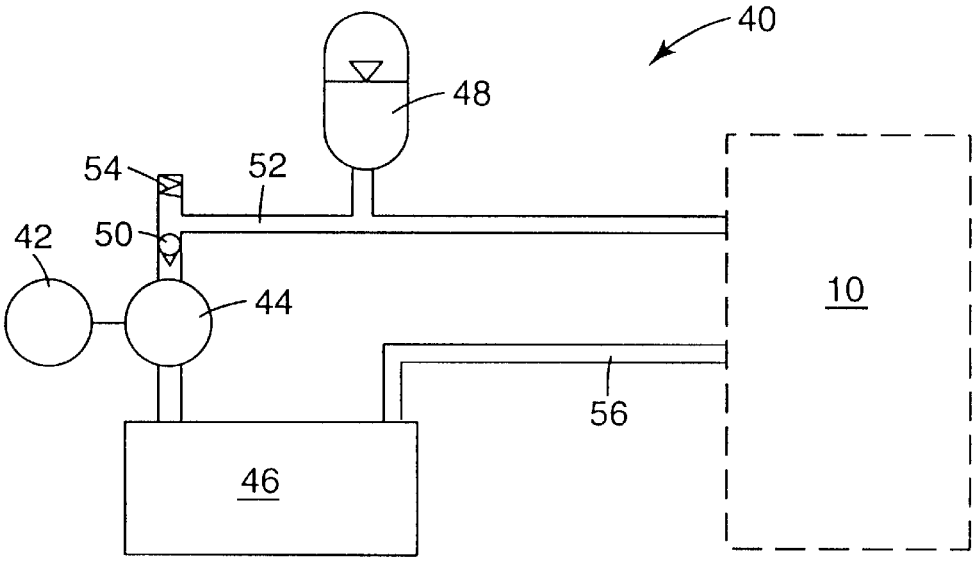
FIG. 2 is a schematic circuit diagram of a hydraulic steering system in accordance with the present invention.

FIG. 2 is a schematic illustration of a hydraulic steering system 40 in accordance with the present invention. Motor 42 is electrically coupled to the electrical system of the drive unit 18 (not shown) to drive pump 44. The pump 44 draws hydraulic fluid from a reservoir 46 to pressurize an accumulator 48 that supplies pressurized hydraulic fluid to the hydraulic steering assembly 10. Check valve 50 is preferably provided in the hydraulic supply line 52 along with a pressure relief valve 54. Hydraulic return line 56 fluidly couples the hydraulic steering assembly 10 to the reservoir 46. In the illustrated embodiment, the motor 42 is activated in response to a decrease of pressure in the accumulator 48 so as to maintain a minimum level of pressurized hydraulic fluid to the hydraulic steering assembly 10. Use of the accumulator 48 has the added benefit of minimizing the frequency with which power is drawn from the drive unit 18 to power the present hydraulic steering assembly 10.

FIGS. 3–6 are various views of the hydraulic steering assembly 10 in accordance with the present invention. The linkage assembly 24 is coupled to the valve assembly 30 by a cable 60 contained within a sheath 62. The sheath 62 is attached to the valve assembly 30 by a sheath mounting flange 64. The cable 60 is attached to a cable connector 66 that extends through the valve assembly 30. The cable connector 66 is pivotally mounted to a connecting linkage 68 by a pin 70. The connecting linkage 68 has a steering linkage connecting point 72 that is coupled to the tiller 26 (not shown).

The valve assembly 30 and double-acting hydraulic cylinder 32 are preferably a single housing. The hydraulic steering assembly 10 is mounted to the vehicle 8 by a mounting bracket 74. Consequently, movement of the cable 60 within the sheath 62 results in displacement of the connecting linkage 68 along axis 74. When the cable 60 is moved in first direction 110, the connecting linkage 68, and hence the drive unit 18, also move in the first direction. Similarly, when the cable 60 is moved in second direction 118, the connecting linkage 68, and hence the drive unit 18, also move in the second direction 118. Therefore, the drive unit 18 can be steered even if the hydraulic steering assembly 10 is not functioning.

The cable connector 66 moves freely within sleeve 76 along axis 74. The total travel of the cable connector 66 within the sleeve 76 is about 20 centimeters (8 inches). Sleeve 76, in turn, moves within the valve assembly 30 along the axis 74. The sleeve 76 is permitted to traverse gaps 134 within the valve assembly 30. Movement of the sleeve 76 is constrained by washers 130 that abut shoulders 132. The total movement of the sleeve 76 is about 5 millimeters (0.2 inches). Sleeve 76 includes a rack portion 78 that is mechanically coupled to a rotating barrel 84 on rotary valve 80 at a rack and pinion interface 82 (see FIG. 4). The axis of the barrel 84 is preferably perpendicular to the axis 74 of the cable connector 66 and sheath 62. Similarly, the cable connector 66 is preferably parallel to cylinder rod 116.

The valve assembly 30 comprises a rotary valve 80 with a rotating barrel 84 positioned opposite a port cap 86 at a valve interface 100 for alternately directing fluid through a first cylinder port 88 and a second cylinder port 90. Hydraulic pressure at the valve interface 100 generates a first force to bias the barrel 84 away from the port cap 86. The barrel 84 includes a first valve piston 92 positioned opposite first cylinder port 88. Second valve piston 96 is positioned above the second cylinder port 90. Third valve piston 98 is positioned opposite pressure port 94. The pressure port 94 is fluidly coupled to the hydraulic supply line 52. The valve pistons 90, 96, 98 utilize hydraulic pressure to generate a second force opposing the first force to bias the barrel 84 against the port cap 86 at a valve interface 100. The first force is preferably substantially equal to the second force so that a hydraulic balance is maintained between the barrel 84 and the port cap 86 at the valve interface 100. Return port 102 is fluidly coupled to the hydraulic return line 56. The rotary valve 80 is retained in the valve assembly 30 by a valve cap 104 having a roller bearing 106 that engages the valve pistons 90, 96, 98. O-ring 108 may optionally be provided between the valve cap 104 and valve assembly 30.

When the cable 60 is moved in a second direction 118, a first reaction force in the first direction 110 is imparted to the sleeve 76 by the sheath 62. Rack 78 on the sleeve 76 rotates the barrel 84 to a first rotated position (see FIG. 11). As will be discussed in detail below, the first rotated position directs hydraulic fluid from the pressure port 94 to the first cylinder port 88. The pressurized hydraulic fluid enters first chamber 112 and urges piston 114 and cylinder rod 116 in the first direction 110. Simultaneously, the second cylinder port 90 is fluidly coupled with the return port 102 to permit hydraulic fluid in second chamber 120 to return to the reservoir 46. Hydraulic fluid will continue to flow into the first chamber until the cable 60 stops moving. When the cable 60 stops moving, tension between the static cable 60 and the moving piston 114 creates a second reaction force in the second direction 118, that is imparted to the sleeve 76 by the sheath 62. The second reaction force rotates the barrel 84 in the opposite direction to a neutral position that terminates the flow of hydraulic fluid (see FIG. 9). Once in the neutral position, hydraulic fluid is trapped in the first and second chambers 112, 120, thereby retaining the drive unit 18 in the desired position.

When the cable 60 is moved in a first direction 110, a second reaction force in the second direction 118 is imparted to the sleeve 76 by the sheath 62. Rack 78 on the sleeve 76 rotates the barrel 84 to a second rotated position (see FIG. 10). The second rotated position directs hydraulic fluid from the pressure port 94 to the second cylinder port 90. The pressurized hydraulic fluid enters second chamber 120 and urges piston 114 and cylinder rod 116 in the second direction 110. Simultaneously, the first cylinder port 88 is fluidly coupled with the return port 102 to permit hydraulic fluid in first chamber 112 to return to the reservoir 46. Hydraulic fluid continues to flow into the second chamber 120 until tension on the cable 60 creates a first reaction force in the first direction 110, that is imparted to the sleeve 76 by the sheath 62. The first reaction force rotates the barrel 84 in the opposite direction to a neutral position and terminates the flow of hydraulic fluid (see FIG. 9).

In the neutral position, hydraulic fluid is trapped on either side of the piston 114. In the event hydraulic pressure is lost, the rotary valve 80 will continue to operate. In response to movement of the cable 60, the rotary valve 80 will open to allow hydraulic pressure trapped on one side of the piston 114 to be released to the reservoir 46. Therefore, even without hydraulic pressure, the drive unit 18 can be steered manually with minimal resistance from the double-acting hydraulic cylinder 32.

Figure 7:
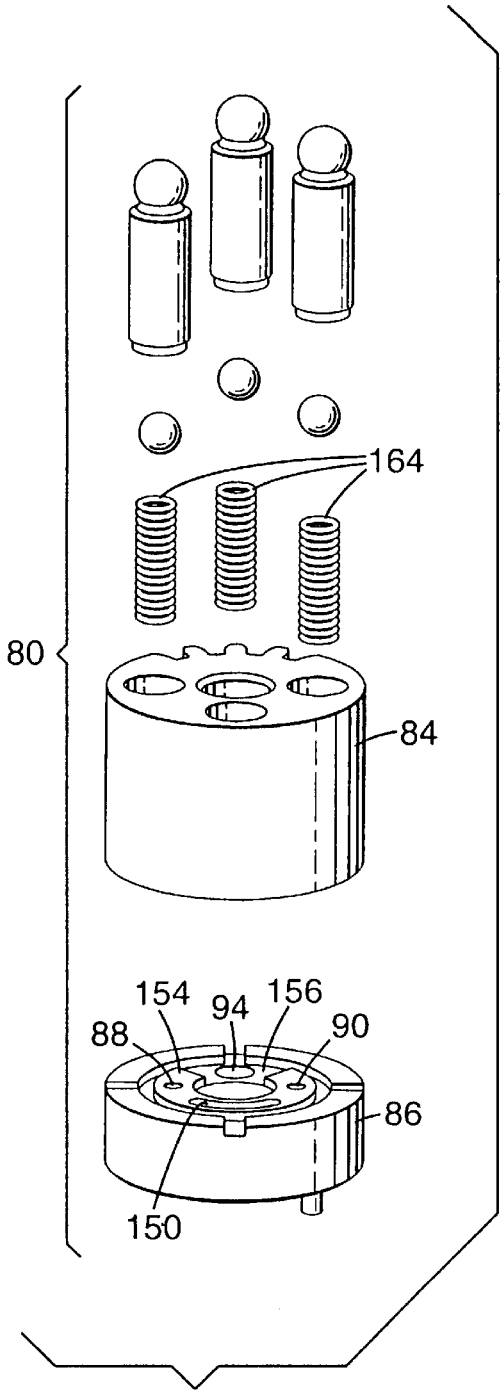
FIG. 7 is an exploded perspective view of the rotary valve illustrated in FIG. 3.
Figure 8:
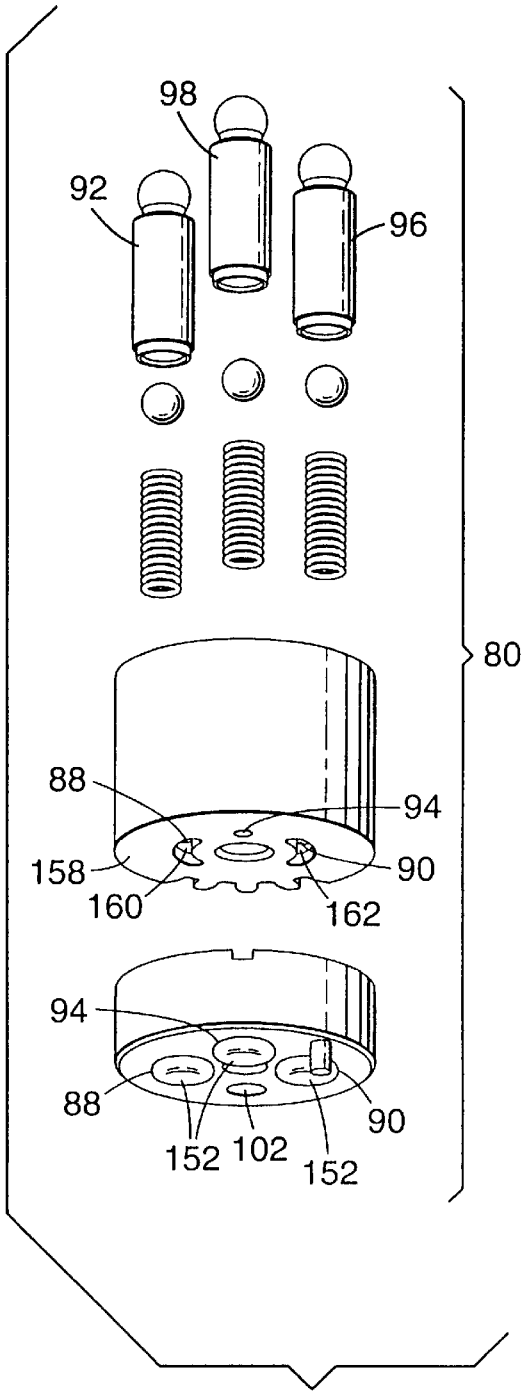
FIG. 8 is an exploded perspective view of the rotary valve of FIG. 7 taken from a lower angle.

FIGS. 7 and 8 are perspective exploded views of the rotary valve 80 from different angles. The pressure port 94 extends from the bottom of the port cap 86 (FIG. 8) to a pressure port slot 150 (FIG. 7). The first cylinder port 88 and second cylinder port 90 both extend directly through the port cap 86 and open on raised surface 154. The bottom of the port cap 86 can optionally include recesses 152 around the various ports 88, 90, 94 for receiving an o-ring or other sealing device.

The openings in the top of the port cap 86 for the first cylinder port 88, second cylinder port 90 and pressure port slot 150 are all formed on a raised surface 154. Return port 94 is located in a recess 156 on the top of the port cap 86. The raised surface 154 is positioned to engage with a lower surface 158 on the bottom of the barrel 84. An extension of the pressure port 94 is located on the lower surface 158 of the barrel 84 and positioned to engage with the pressure port slot 150 on the raised surface 154 of the port cap 86. A first cylinder slot 160 is located on the lower surface 158 and positioned to fluidly couple with the first cylinder port 88 on the raised surface 154 of the port cap 86. Similarly, a second cylinder port 162 is located on the lower surface 158 and positioned to fluidly couple with the second cylinder port 90 on the raised surface 154 of the port cap 86.

The extension of the pressure port 94 in the barrel 84 fluidly couples with an interior portion of a third valve piston 98. The hydraulic surface area of the interior portion of the valve piston 98 (see FIG. 4) is substantially equal to the hydraulic surface area of the pressure port slot 150 on the port cap 86. Hydraulic surface area refers to the surface area upon which the pressurized hydraulic fluid acts to generate a force in a particular direction. Consequently, the hydraulic pressure in the valve piston 98 generates a second force that counteracts the first force generated by the hydraulic pressure in the pressure port slot 150, thereby maintaining the valve interface 100 between the barrel 84 and port cap 86.

Figure 3:
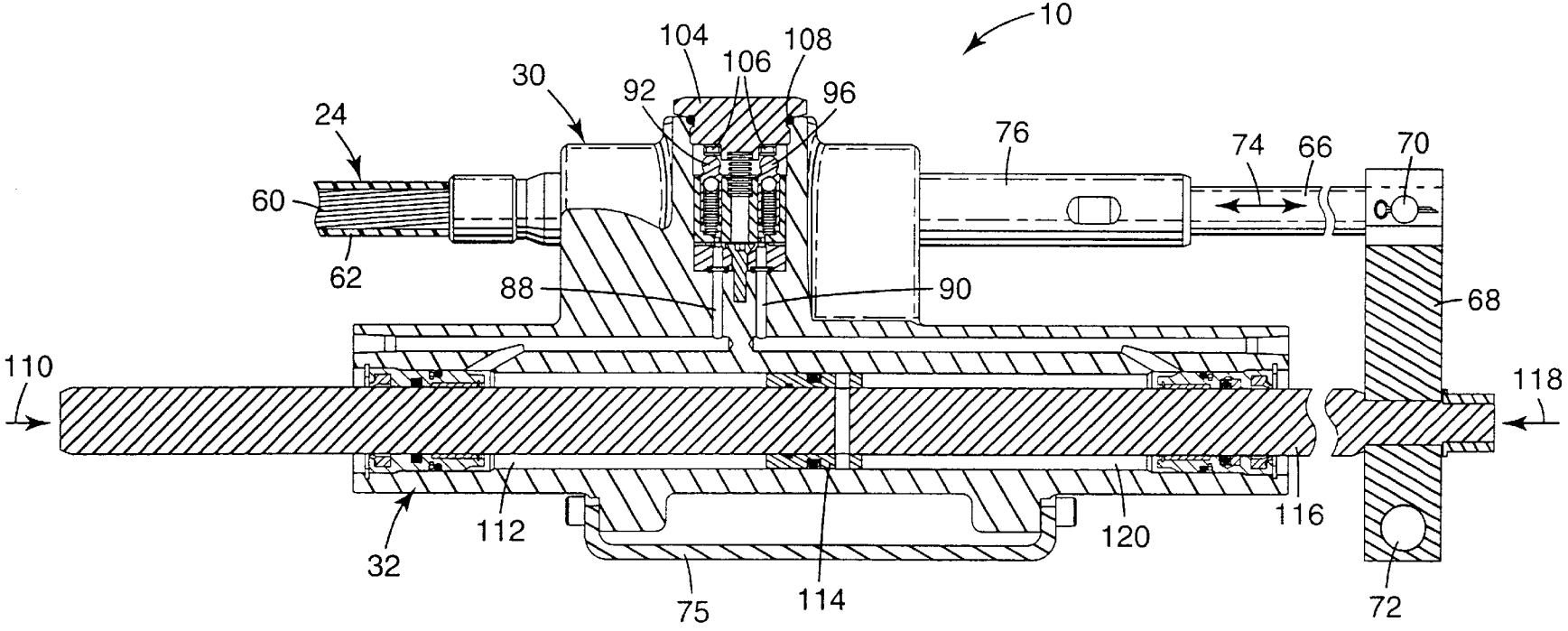
FIG. 3 is a side sectional view of a hydraulic steering assembly in accordance with the present invention.
Figure 4:
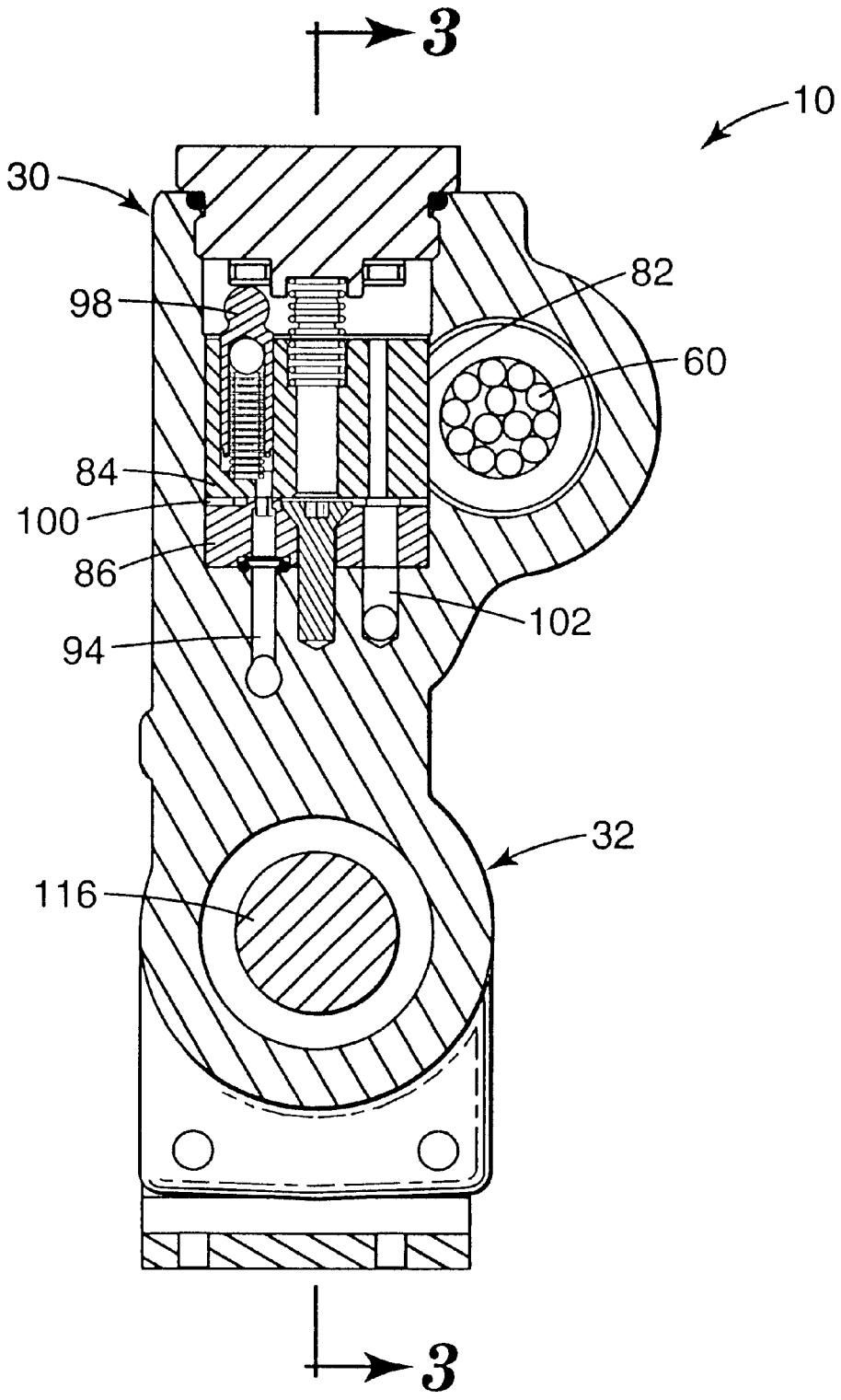
FIG. 4 is a cross-sectional view of the hydraulic steering assembly of FIG. 3.
Figure 5:
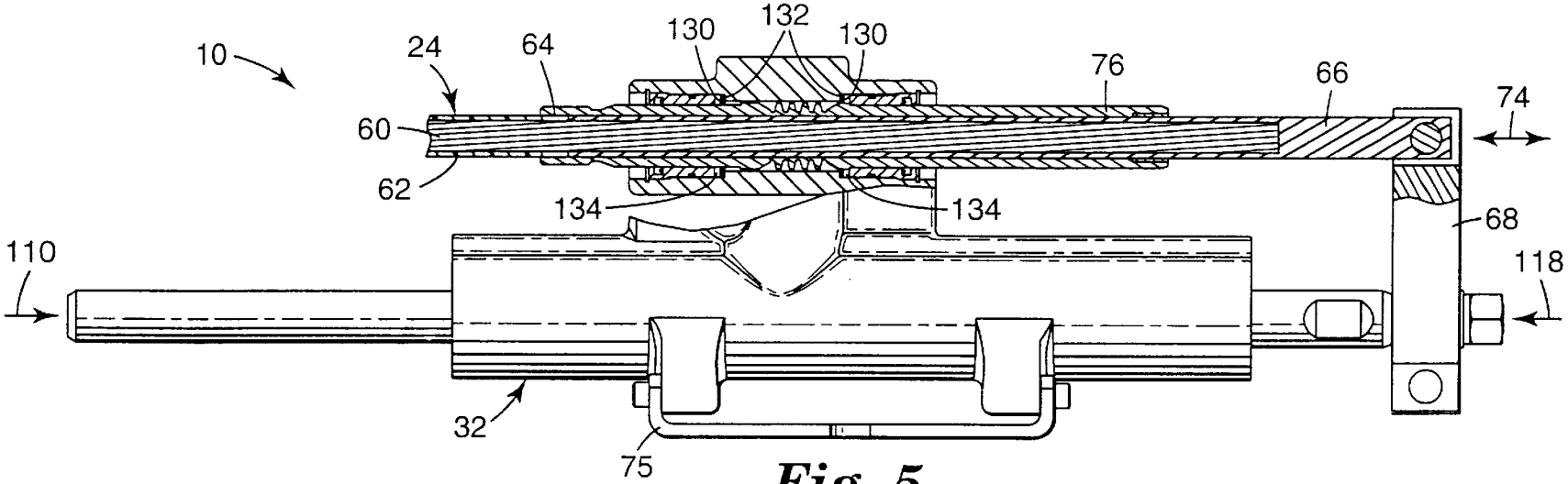
FIG. 5 is a cross-sectional view of a portion of the valve assembly shown in FIG. 3.
Figure 6:
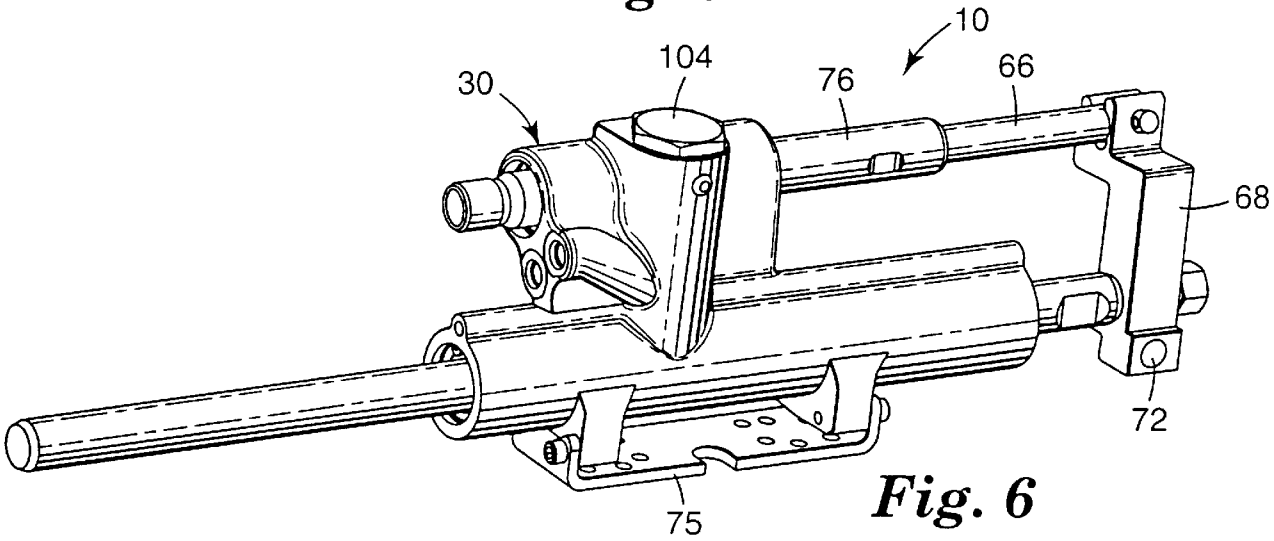
FIG. 6 is a perspective view of the hydraulic steering assembly of FIG. 3.

Similarly, the first cylinder port 88 and second cylinder port 90 extend from their respective cylinder slots 160, 162 through the barrel 84 to respective valve pistons 92, 96 (see FIG. 3). The hydraulic surface area within the valve pistons 92, 96 is substantially equal to the hydraulic surface area of the respective port cylinder slots 160, 162. Each of the valve pistons 92, 96, 98 act independently with their respective slots 150, 160, 162. When the barrel is in the first rotated position, the pressure port 94 is in fluid communication with the valve pistons 92, 96. When the barrel is in the second rotated position, the pressure port 94 is in fluid communication with the valve pistons 92, 98. Consequently, the second biasing force generated by the valve pistons 92, 96, 98 is substantially equal to the first force caused by the presence of pressurized hydraulic fluid at the valve interface 100 between the barrel 84 and the port cap 86 during all phases of valve operation. The first and second forces maintain a hydraulic balance at the valve interface 100. Compression springs 164 provide a preload that biases the barrel 84 toward the port cap 86.

Figure 9:
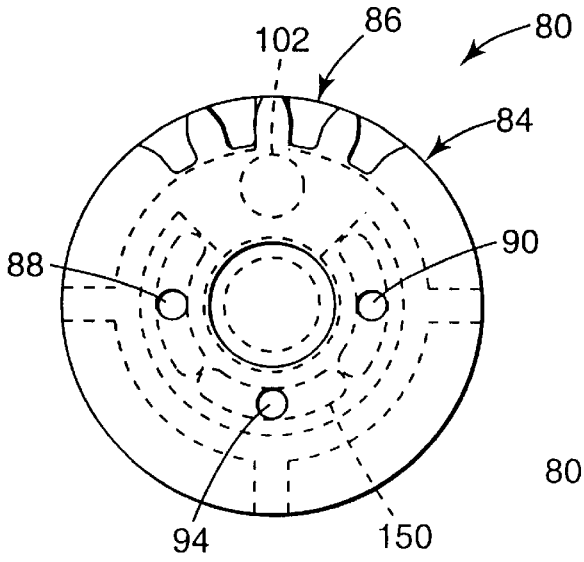
FIG. 9 is a cross-sectional view of the valve of FIG. 7 in a neutral position.
Figure 10:
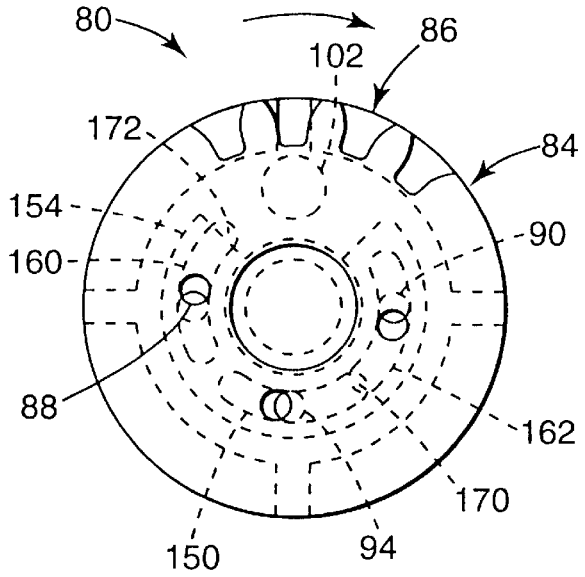
FIG. 10 is a cross-sectional view of the valve of FIG. 7 configured in the second rotated position.
Figure 11:
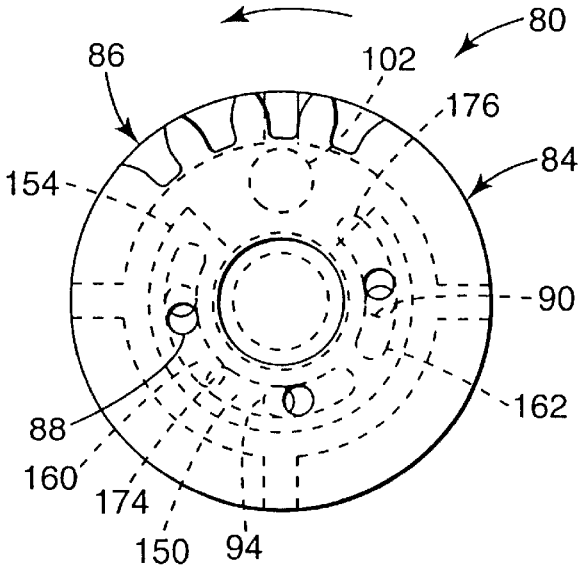
FIG. 11 is a cross-sectional view of the valve of FIG. 7 configured in the first rotated position.

FIG. 9–11 illustrate various configurations of the valve interface 100 between the barrel 84 and the port cap 86. FIG. 9 illustrates the rotary valve 80 in a neutral position. Pressure port 94 on the barrel 84 is fluidly coupled to the pressure port slot 150 on the pressure cap 86, but is not in fluid communication with either of the cylinder ports 88, 90 or the return port 102. No hydraulic fluid flow to the double acting cylinder 32 when the rotary valve 80 is in the neutral position. As discussed above, when the motion of the steering wheel 22 is stopped, the continued movement of the piston 114 creates tension with the cable 60 to cause a reaction force that rotates the rotary valve 80 to neutral position. When the rotary valve 80 is in the neutral position, the current steering position is maintained by the static pressure of the hydraulic fluid trapped in the chambers 112, 120. No additional pressurized hydraulic fluid from the accumulator 48 is required to maintain the current steering position.

FIG. 10 illustrates the configuration of the various ports at the valve interface 100 when the barrel 84 is in the second rotated position, viewed from the bottom. Rotation of the barrel 84 forms an overlap region 170 between the pressure port slot 150 on the pressure cap 86 and the second cylinder slot 162 on the barrel 84. Similarly, the first cylinder slot 160 now extends past the raised surface 154 to form an overlap region 172 adjacent to the return port 102. In the configuration illustrated in FIG. 10, pressurized hydraulic fluid flows from the pressure port 94 through the overlap region 170 to the second cylinder port 90, and ultimately to the second chamber 120 of the double acting boost cylinder 32. Simultaneously, hydraulic fluid is expelled from the first chamber 112 through the first cylinder port 88 to the overlap region 172, and ultimately to the return port 102.

FIG. 11 illustrates the configuration of the rotary valve 80 when the barrel 84 is in the first rotated position, viewed from the bottom. The first cylinder slot 160 is shifted counter-clockwise to form an overlap region 174 with the pressure port slot 150. Similarly, the second cylinder slot 162 now extends past the raised surface 154 to form an overlap 176 in fluid communication with the return port 102. In the configuration illustrated in FIG. 11, pressurized hydraulic fluid moves through the pressure port 94, through the overlap 174 to the first cylinder port 88, and ultimately into the first chamber 112 of the double acting boost cylinder 32. Simultaneously, fluid is expelled from the second chamber 120 through the second cylinder port 90 and the overlap 176, where it is returned to the reservoir 46 through the return port 102. Hydraulic fluid is provided to the valve pistons 92, 96, 98 at all times during operation of the rotary valve 80 (i.e., in the first position, second position and neutral position).

Patents and patent applications cited herein, including those cited in the Background, are incorporated by reference in total. It will be apparent to those skilled in the art that many changes can be made in the embodiments described above without departing from the scope of the invention. Thus, the scope of the present invention should not be limited to the methods and structures described herein, but only to methods and structures described by the language of the claims and the equivalents thereto. By way of example, a hydraulic steering system that functions in the manner described and claimed herein can be implemented in a wide variety of known or otherwise available assembly arrangements. The present hydraulic steering system can also be used in land vehicles and other applications.

What is claimed is:

1. A power-assist hydraulic system for use in connection with a linkage extending through a housing and mechanically coupled to an actuated member, the power-assisted hydraulic system comprising:

a double-acting hydraulic cylinder having a rod configured for interconnection to the actuated member;

an accumulator for storing pressurized hydraulic fluid;

a rotary valve having a valve interface for selectively connecting the hydraulic cylinder to the accumulator, the rotary valve having at least one valve piston for receiving pressurized hydraulic fluid to maintain a hydraulic balance at the valve interface; and a sleeve having a bore through which the linkage can extend, mechanically coupled and movably mounted with respect to the rotary valve for moving the rotary valve between a neutral position and first and second rotated positions in response to forces between the linkage and housing, wherein the sleeve and rotary valve cooperate to drive the hydraulic cylinder in a first or a second direction in response to the rotary valve being in the first or the second rotated position, respectively.

2. The power-assist hydraulic system of claim 1 wherein the pressurized hydraulic fluid generates a first force at the valve interface and a second opposing force in the valve piston.

3. The power-assist hydraulic system of claim 2 wherein the first and second forces are substantially equal.

4. The power-assist hydraulic system of claim 1 further comprising a biasing mechanism positioned to maintain the valve interface.

5. The power-assist hydraulic system of claim 1 wherein the valve interface defines a first hydraulic surface area and the valve piston defines a second opposing hydraulic surface area substantially equal to the first hydraulic surface area.

6. The power-assist hydraulic system of claim 1 wherein the at least one valve piston comprises a plurality of valve pistons positioned to transmit hydraulic pressure to the valve interface.

7. The power-assist hydraulic system of claim 1 wherein the valve interface comprises at least three ports and a valve piston opposite each of the ports to transmit hydraulic pressure to the valve interface.

8. The power-assist hydraulic system of claim 1 wherein the rotary valve comprises a port cap retained in the housing and a barrel rotatably coupled to the linkage, the port cap and the barrel defining the valve interface.

9. The power-assist hydraulic system of claim 8 wherein the valve interface of the port cap and the barrel defines a first hydraulic surface area and the valve piston located in the barrel defines a second opposing hydraulic surface area substantially equal to the first hydraulic surface area.

10. A hydraulic steering system for use in combination with a linkage mechanically coupled to an actuated member, the hydraulic steering system having a hydraulic pump, an accumulator for storing pressurized hydraulic fluid and a reservoir of hydraulic fluid, the hydraulic steering system comprising:

a double-acting hydraulic cylinder having a piston mechanically coupled to the actuated member and configured to move along a first axis in a first direction and a second direction;

a sleeve slideably engaged with a valve housing, the sleeve having a through hole for receiving the linkage, the linkage transmitting a first reaction force to move the sleeve in the first direction in response to the linkage moving in the second direction, and a second reaction force to move the sleeve in the second direction in response to the linkage moving in the first direction;

a rotary valve assembly having a valve interface for selectively connecting the double-acting hydraulic cylinder to the accumulator, the rotary valve assembly having at least one valve piston for receiving pressurized hydraulic fluid to maintain a hydraulic balance at the valve interface; and a mechanical interface between the sleeve and the rotary valve to rotate the rotary valve from a neutral position to a first or a second rotated positioned in response to the first and second reaction forces.

11. The hydraulic steering system of claim 10 wherein the linkage comprises a cable contained within a sheath, the sleeve comprising a fitting to mechanically couple with the sheath.

12. The hydraulic steering system of claim 10 wherein the pressurized hydraulic fluid generates a first force at the valve interface and a second opposing force in the valve piston.

13. The hydraulic steering system of claim 10 wherein the first and second forces are substantially equal.

14. The hydraulic steering system of claim 10 further comprising a biasing mechanism positioned to maintain the valve interface.

15. The hydraulic steering system of claim 10 wherein the valve interface defines a first hydraulic surface area and the valve piston defines a second opposing hydraulic surface area substantially equal to the first hydraulic surface area.

16. The hydraulic steering system of claim 10 wherein the at least one valve piston comprises a plurality of valve pistons positioned to transmit a biasing force on the valve interface.

17. The hydraulic steering system of claim 10 wherein the valve interface comprises at least three ports and a valve piston opposite each of the ports to transmit a biasing force on the valve interface.

18. The hydraulic steering system of claim 10 further comprising:

a first valve piston fluidly coupled to a pressure port and positioned to transmit a biasing force on the valve interface when in the first rotated position;

a second valve piston fluidly coupled to the pressure port and positioned to a biasing force on the valve interface when in the second rotated position; and a third valve piston fluidly coupled to the pressure port and positioned to transmit a biasing force on the valve interface when in the neutral position.

19. The hydraulic steering system of claim 10 wherein the rotary valve comprises a port cap retained in the housing and a barrel rotatably coupled to the linkage, the port cap and the barrel defining the valve interface.

20. The hydraulic steering system of claim 19 wherein the interface of the port cap and the barrel defines a first hydraulic surface area and the valve piston located in the barrel defines a second opposing hydraulic surface area substantially equal to the first hydraulic surface area.

21. The hydraulic steering system of claim 19 wherein the port cap comprises a first surface comprising a first cylinder port fluidly coupled to a first chamber of the double-acting cylinder to drive the piston in the first direction upon application of pressurized hydraulic fluid, a second cylinder port fluidly coupled to a second chamber of the double-acting cylinder to drive the piston in the second direction upon application of pressurized hydraulic fluid, a pressure port fluidly coupled to the accumulator and a return port fluidly coupled to the reservoir; and the barrel assembly comprises a second surface engaged with the first surface at the valve interface, the barrel assembly being rotatable from a neutral position to a first rotated position and a second rotated position, the first and second surfaces being configured to fluidly coupling the pressure port with the first cylinder port and the second cylinder port with the return port in the first rotated position, and for fluidly coupling the pressure port with the second cylinder port and the first cylinder port with the return port in the second rotated position.

22. The hydraulic steering system of claim 19 wherein the pressure port on the port cap comprises a pressure port slot defining a surface area substantially equal to a surface area define by the third valve piston.

23. The hydraulic steering system of claim 19 wherein the second surface comprises a first port cylinder slot defining a surface area substantially equal to the surface area defined by the first valve piston.

24. The hydraulic steering system of claim 19 wherein the second surface comprises a second port cylinder slot defining a surface area substantially equal to the surface area defined by the second valve piston.

25. The hydraulic steering system of claim 19 wherein the second surface comprises a first port cylinder slot configured to fluidly couple the first port cylinder with the pressure port in the first rotated position.

26. The hydraulic steering system of claim 19 wherein the second surface comprises a first port cylinder slot configured to fluidly couple the first port cylinder with the return port in the second rotated position.

27. The hydraulic steering system of claim 19 wherein the second surface comprises a second port cylinder slot configured to fluidly couple the second port cylinder with the pressure port in the first rotated position.

28. The hydraulic steering system of claim 19 wherein the second surface comprises a second port cylinder slot configured to fluidly couple the second port cylinder with the return port in the second rotated position.

29. The hydraulic steering system of claim 10 wherein the mechanical interface between the sleeve and the rotary valve comprises a rack and pinion structure.

30. The hydraulic steering system of claim 10 wherein the through hole of the sleeve is generally parallel with the first axis.

31. The hydraulic steering system of claim 10 further comprising an electric motor coupled to the hydraulic pump.

32. The hydraulic steering system of claim 10 wherein force from the linkage caused by movement of the piston generates a reaction force to rotate the rotary valve from the first or the second rotated positions to the neutral position.

33. The hydraulic steering system of claim 10 wherein the first and second directions of the sleeve are parallel to the first axis.

34. The hydraulic steering system of claim 10 wherein the rotary valve assembly and the double-acting hydraulic cylinder comprise a single housing.

35. The hydraulic steering system of claim 10 wherein an axis of rotation of the rotary valve is perpendicular to the sleeve.

36. A boat having the hydraulic steering system of claim 10.

* * * * *